US008434824B2

(12) United States Patent
Spinabella et al.

(10) Patent No.: US 8,434,824 B2
(45) Date of Patent: May 7, 2013

(54) PHYSICAL ACTIVITY APPARATUS AND KIT

(75) Inventors: Kathy Spinabella, Mundelein, IL (US); Ronald Spinabella, Sr., Mundelein, IL (US); Roberta Singer, Newburyport, MA (US)

(73) Assignee: Classroom Seating Solutions, LLC, Lake Zurich, IL (US)

( * ) Notice: Subject to any disclaimer, the term of this patent is extended or adjusted under 35 U.S.C. 154(b) by 25 days.

(21) Appl. No.: 13/114,038

(22) Filed: May 23, 2011

(65) Prior Publication Data

US 2012/0138113 A1 Jun. 7, 2012

Related U.S. Application Data

(60) Provisional application No. 61/347,335, filed on May 21, 2010.

(51) Int. Cl.

| | |
|---|---|
| ***A47C 7/50*** | (2006.01) |
| ***A63B 23/08*** | (2006.01) |
| ***A63B 23/10*** | (2006.01) |
| ***A63B 21/04*** | (2006.01) |

(52) U.S. Cl.
USPC ..... 297/423.1; 108/50.14; 482/79; 482/129

(58) Field of Classification Search ..... 108/25, 108/26, 50.14, 92, 96, 106, 182, 188; 297/423.1, 297/423.39; 482/79, 80, 121, 129, 130, 148
See application file for complete search history.

(56) References Cited

U.S. PATENT DOCUMENTS

| | | | | |
|---|---|---|---|---|
| 47,831 | A * | 5/1865 | Hussey | 108/26 |
| 402,130 | A * | 4/1889 | Bedford | 297/273 |
| 1,529,175 | A * | 3/1925 | Dunn | 297/423.1 |
| 2,407,646 | A * | 9/1946 | Best | 297/466 |
| 2,606,593 | A * | 8/1952 | Beurskens | 280/7.1 |
| 4,676,174 | A * | 6/1987 | Dingeldey | 108/157.1 |
| 4,765,005 | A * | 8/1988 | Hippel | 5/648 |
| 4,852,874 | A * | 8/1989 | Sleichter et al. | 482/122 |
| 5,620,397 | A * | 4/1997 | Chieh | 482/46 |
| 7,452,034 | B2 | 11/2008 | Jung | |
| 7,549,705 | B2 | 6/2009 | Man et al. | |
| 7,565,869 | B2 | 7/2009 | Daniel | |
| 7,611,207 | B2 | 11/2009 | Barfuss | |
| 2003/0228944 | A1 * | 12/2003 | Scruby | 473/496 |
| 2009/0107533 | A1 * | 4/2009 | Nativ | 135/67 |
| 2009/0178596 | A1 | 7/2009 | Skiba | |

* cited by examiner

*Primary Examiner* — David Dunn
*Assistant Examiner* — Philip Gabler
(74) *Attorney, Agent, or Firm* — Joseph Golant

(57) ABSTRACT

The present invention provides for a universal foot assembly having a foot pedal that may be attached to a desk or workstation that can be adjustably configured to allow for the foot pedal to vibrate, rotate, or move in a number of directions. The foot assembly comes as part of a kit and is configurable for retrofit attachment to existing desks and workstations. The foot assembly helps students having ADD or ADHD expend nervous energy. It also provides a valuable exercise mechanism for those trying to improve their physical health.

18 Claims, 9 Drawing Sheets

PHYSICAL ACTIVITY APPARATUS AND KIT

This application claims the benefit of U.S. Provisional Patent Application Ser. No. 61/347/335, filed May 21, 2010.

FIELD OF THE INVENTION

This invention relates to creating an environment for a student that is conducive to the student's mental relaxation and to his physical body relaxation so that he or she can concentrate more easily, with fewer mental and physical distractions, in a scholastic environment, on his or her school work.

BACKGROUND OF THE INVENTION

This invention is designed primarily for the students who are children to teenaged youth who are students in school, in classes ranging thereof from fourth grade in a grammar school, to seniors in their fourth year of high school.

The students necessarily will range in height from approximately forty-five inches to about seventy-eight inches. The main characteristic of each student will be the possession of excess energy, which prevents him or her from focusing their attention on the academic material being presented to them by the teacher.

Some students are very sluggish and tend to lay their heads on their desk or prop themselves or their head up on their elbows. Other students are so filled with energy that they can't stop their wiggles or stop bother their neighbors and preventing them from having their attention on what the teacher is presenting to the class. Both students need help in their preparation in the classroom to learn.

Recent studies have suggested that students' learning may be improved as a result of greater comfort and alteration of the desk, permits the student to stand while using the classroom desk. Teachers in several states have reported that they know from experience that standup desks facilitate the student's need to expend energy and at the same time focus better on their scholastic work rather than focusing on how to sit still or keep still.

Among the results reported from the studies are that activity permissive classrooms, including standup desks, give the children the flexibility they need to expend energy and at the same time focus better on their work as compared with students monitored while using traditional desks, wherein the researchers are looking for differences in physical activity and academic achievement.

SUMMARY OF THE INVENTION

What is needed is an "activity permissive" classroom with standup desks that allow the children to have the flexibility they need to expend energy and at the same time focus better on their academic work so as to obtain the academic results the parents desire.

The instant invention utilizes a standup desk that combines the standup desk with a novel device, a physical activity apparatus, that in combination with the desk permits the student to expend energy in the classroom while focusing on his or her academic work without disturbing other fellow students present in the classroom.

The standup desk can be recycled present school desk with four metal legs. The desk can be a present school desk which is modified to lengthen the present legs to raise the desk's work level to a suitable height so that the students can stand and use the desk while the student is standing before the desk.

The physical activity apparatus can be attached to a walker, a workstation, a desk, or any piece of furniture that provides for enough clearance from the floor or ground to allow the physical activity apparatus to rotate, vibrate, or move in a variety of directions without hitting the floor, or the ground, or the attached item.

A connector can be a turnbuckle or other equivalent devices for operational attachment to a desk, workstation, or a piece of furniture.

DETAILED DESCRIPTION OF THE INVENTION

The invention allows the student to use a combination of a standup desk and the physical activity apparatus. The instant invention permits the student to have an enhanced learning environment for meeting the student needs and is conducive to the student's mental and physical relaxation so he or she can focus on his or her academic needs to obtain academic skills.

Because of the differing requirements of individual students in the academic environment, wherein the instant invention will be useful ranging from third or fourth grade in a grammar school setting to a high school environment of up to senior level in a four year high school environment. The standup desk will necessarily differ as to required leg height of the standup desk for each grade level. Each desk for each grade level, when a recycled desk for a specific grade level is used, will require that the four legs of the recycled, present school desk be lengthened so that the student can stand at the recycled school desk with extended legs.

The legs are necessarily extended by attaching tubular metal extensions to each leg with turn screw attachments wherein the leg extension can add up to twelve inches as an extension to each leg depending or added leg length need whether for a third or fourth grade classroom or a high school classroom.

The physical activity apparatus (12) is normally connected to a desk (2), or a workstation (3) [not shown], or a piece of furniture [not shown] (4), and it comes as a kit (25), See FIG. 6.

The physical activity apparatus may also come attached to a walker (30) or walking device, See FIG. 9; or as a standalone device (38), See FIGS. 7 & 8.

The physical activity apparatus (12) can be connected to a desk, workstation, piece of furniture, or any object where the user desires to have an exercise and energy absorbing function available. See FIGS. 1, 5, 7, 8, and 9.

The physical activity apparatus (12) includes bungee cords (14*a*, 14*b*). While the bungee cords are the preferred material of choice, any elastomeric material having the elasticity and resiliency similar to the bungee cords is a suitable material, and can serve as a functional equivalent. The bungee cords are covered by sleeves (16*a*, 16*b*) with a diameter slightly larger than the bungee cords (14*a*, 14*b*) See FIGS. 2A, 2B, and 4.

The sleeves (16*a*, 16*b*) have a diameter that is less than an outside sleeve (18). See FIG. 6 (bottom), See also FIGS. 2A and 2B. The outside sleeve (18) couples the bungee cords to form a footrest, foot pedal, or a footpad (20). See FIG. 2A. The cords are coupled to form a spring mechanism wherein the cords are passed through a two-inch plastic cylinder to form the elastic footrest, foot pedal or footpad held midway between the legs of the standup desk.

The bungee cords are securely attached at a first end (15*a*) and at a second end (15*b*) either directly or more likely by way of a connecting means (17). The connecting means (17) can be any one of a number of mechanisms providing for a connection to the desk (2) or other standing object such as the standalone device 38, FIGS. 7 and 8. The standalone device 38 includes four upstanding legs 40, 42, 44, 46 integral with a crossed base 48. The cords 14*a*, 14*b* are looped through recesses 50, 52, 54, 56 in the legs 40, 42, 44, 46, respectively, so that the sleeve 18 is generally spaced away from the legs and above the crossed base 48. The connecting means allows the bungee cords to operate "freely" as necessary for the vibration, elasticity, and resiliency, to allow the user to expend the necessary energy, to either relieve stress, or help exercise their lower torso, and strengthen their core muscular-skeletal system. As shown in FIGS. 2, 3A, 3B, and 3C the connecting means (17) may be turnbuckles, clips, Velcro straps, heavy duty clamps, and other equivalent means with optional covers (19) to help prevent any damage to the desk, workstation, furniture or other standing object.

Optional leg extensions (22) as shown in FIGS. 5 and 6, can be customized for any standing desk, workstation, or piece of furniture, so the distance between the floor (60) or ground surface and the foot pedal (20) portion of the physical activity apparatus (12) provides enough clearance to allow for the movement, extension, vibration, stretching, and other contortions of the foot pedal. Enough clearance or room is required for the exercising or extension of the foot pedal (20) of the physical activity apparatus (12).

The combination of the foot pedal (20), the connecting means (17), optional leg extensions (22), and covers (19) all come in a kit (25).

The standalone unit would have the foot pedal (20); the connecting means (17), optional covers (19), all in a kit (27).

The connecting means (17) may be made of most any material, and can be powder coated if metallic in nature to avoid scratches against the desk legs, extensions, furniture, or workstation.

The physical activity apparatus kit provides for retrofitting attachment of extensions to an existing desk, workstation, furniture as is illustrated in FIG. 6. The function and purpose of the foot pedal (20) is to provide the advantages listed above. The physical activity apparatus assembly is generally u-shaped, having a pair of depending spaced bungee cords connected at each end, a first end, and a second end, by a connector means, to the existing desk, or workstation, each bungee cord is covered by an inner sleeve, and a pair of bungee cords are covered by an outer sleeve, forming a nexus at the approximate midpoint of the two bungee cords, whereby the bungee cords touch or come toward each other along their mid-portions and form a foot pedal or a footpad.

The foot pedal, with the connecting means help secure and stabilize the physical activity apparatus assembly.

The user receives significant benefits when using the instant invention, the user increases his or her exercise program, increases their core strengthening, increased circulation, burning calories, muscular activation are many of the benefits received from any protracted or long term use of the instant invention. By providing the user the freedom to exercise while otherwise performing a sedentary activity increased cardio, muscular, and skeletal benefits accrue.

The physical activity apparatus is an invented device that may be used in combination with a standup desk, wherein the combination includes the physical activity apparatus and a standup desk, where the physical activity apparatus includes an elastic stirrup for the student's foot to allow the student to exercise his or her legs as he or she wishes in a permissive environment, where the desk may be a recycled standard school desk with extended legs, the legs being lengthened with the application of metal tubular sections to each leg to raise the level of the desk so that the student's foot in the stirrup is above floor level so the student can press down on the stirrup against the spring of the bungee cords attached to the stirrup.

While the instant invention has been described with reference to preferred embodiments, the invention is not to be limited to the described embodiments, or to the limit of options available, or to the use of specific components, configurations, or materials that might be described. All alternative or optional modifications, variations, or embodiments of the present assembly are included within the scope of this invention as set forth in the claims.

Figure 1:
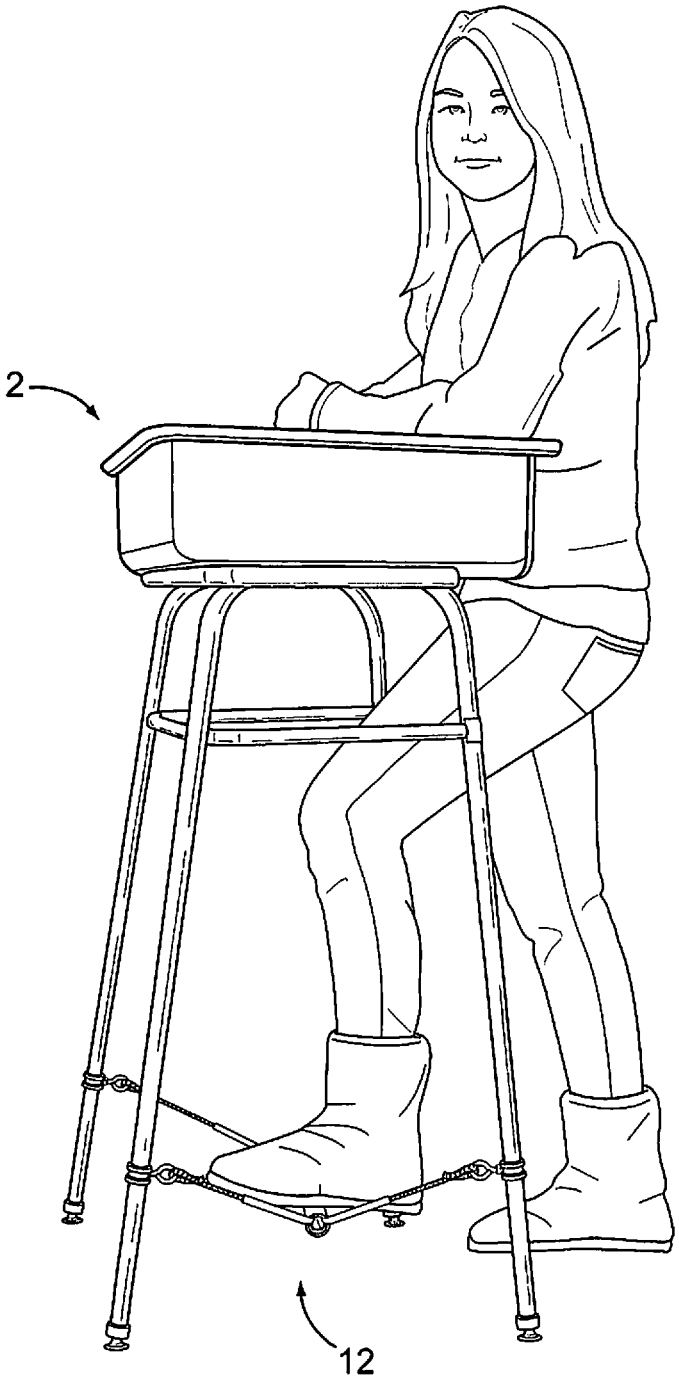
FIG. 1 is an isometric view of a physical activity apparatus attached to the legs of a standup desk and illustrating use of the apparatus by a user of the desk.
Figure 2A:
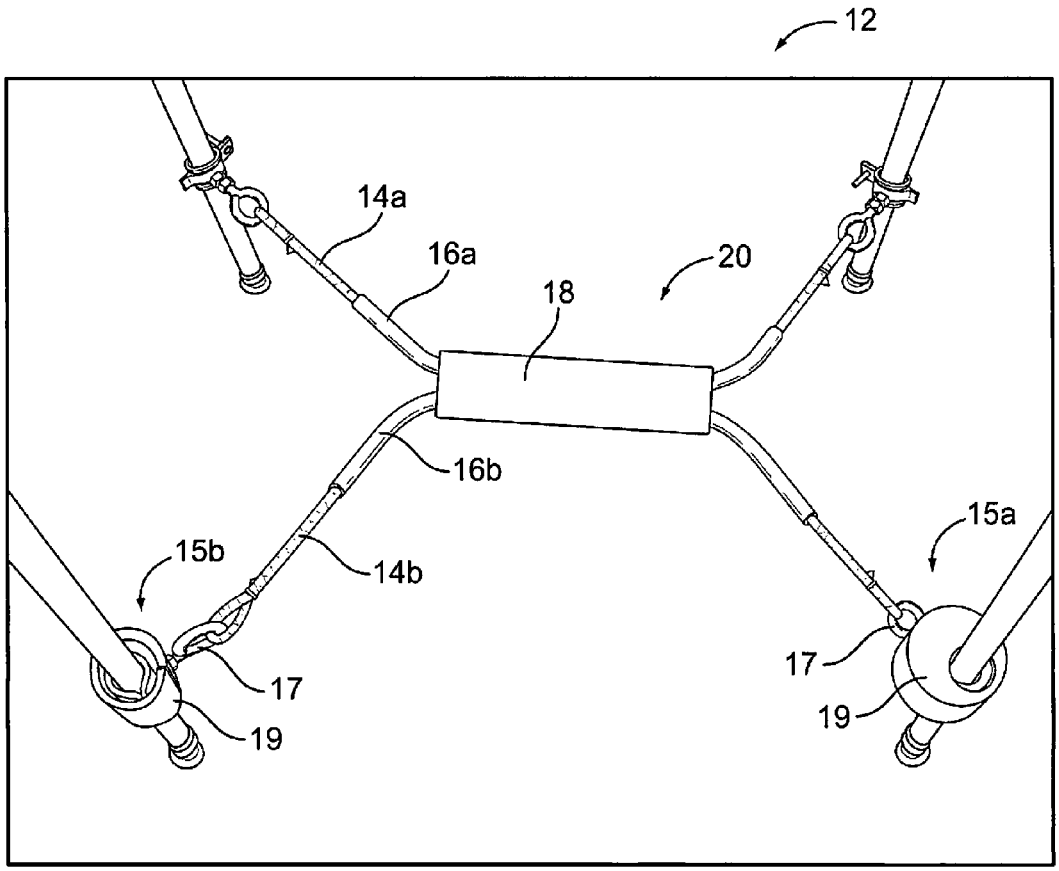
FIG. 2A is an isometric view of the physical activity apparatus attached to the legs of the standup desk.
Figure 2B:
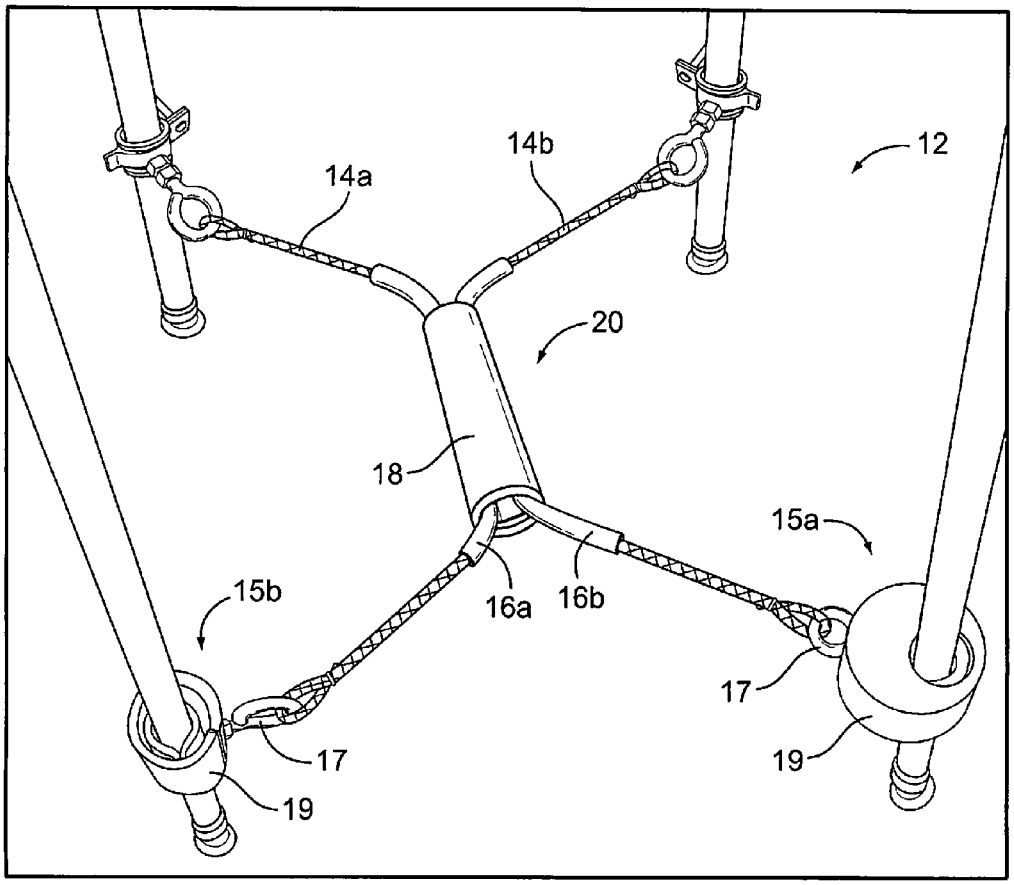
FIG. 2B is another isometric view of the physical activity apparatus attached to the legs of the standup desk.
Figure 3C:
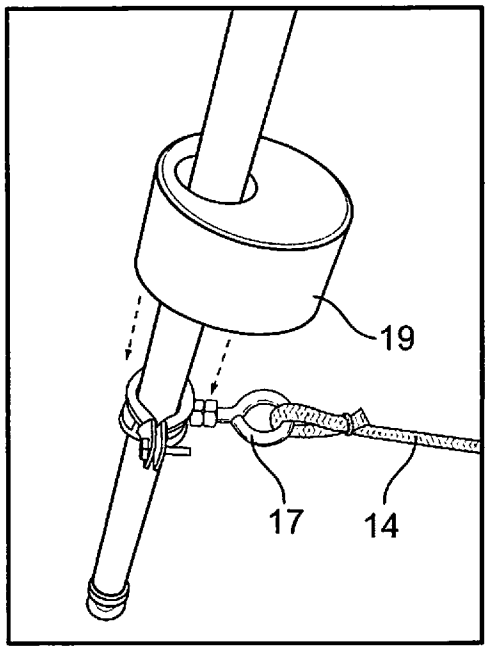
FIGS. 3A, 3B and 3C are isometric view of connectors, such as clamps and eyebolts, for attaching the cords to desk legs.
Figure 3B:
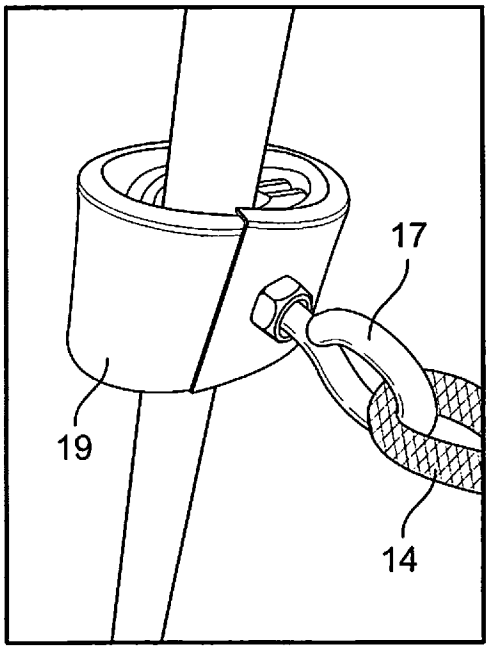
Figure 3A:
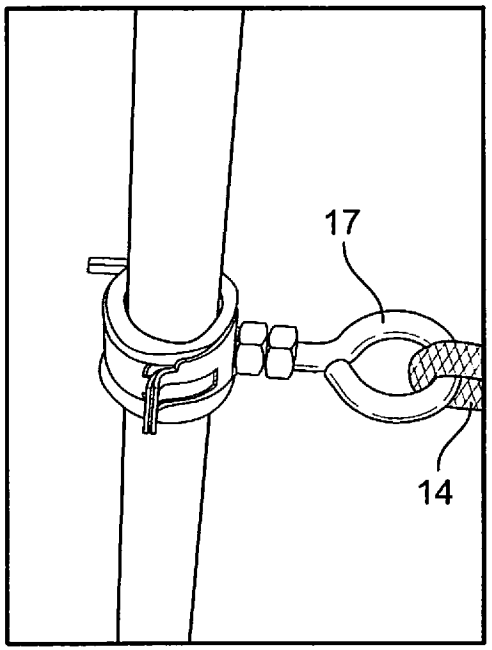
Figure 4:
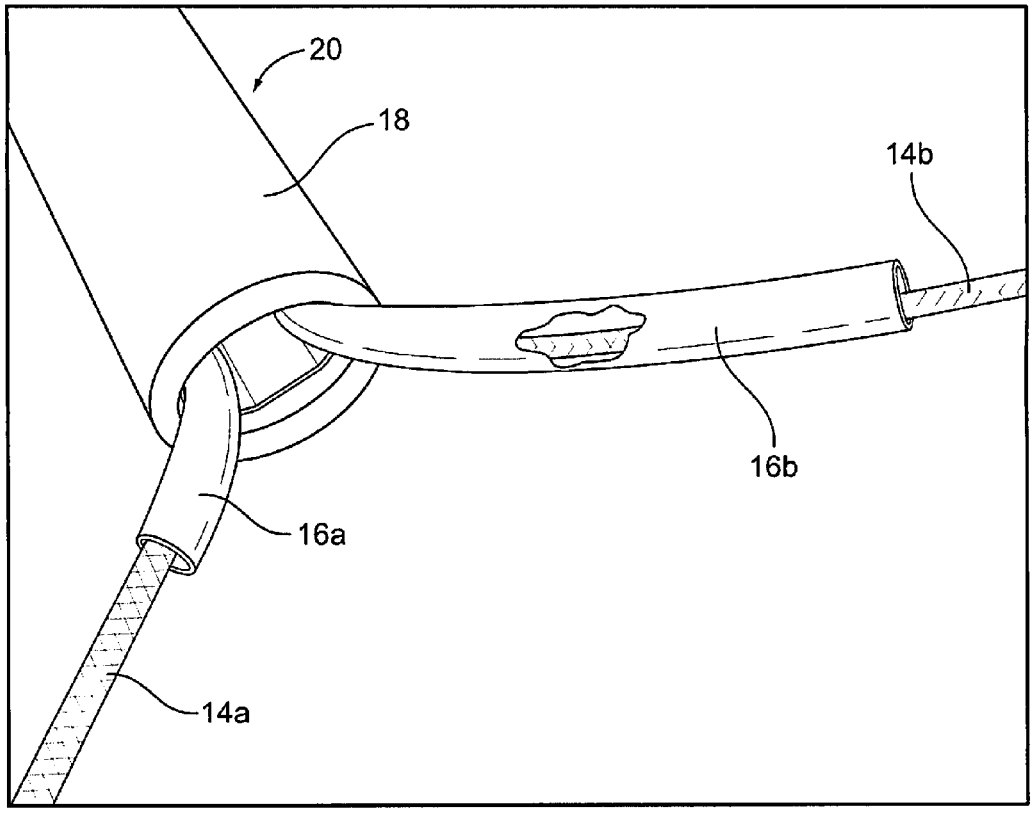
FIG. 4 is an enlarge isometric view of the covered cords entering a two inch plastic cylinder to form a stirrup or footpad for a user's leg, the cover of one cord being partially broken away.
Figure 5:
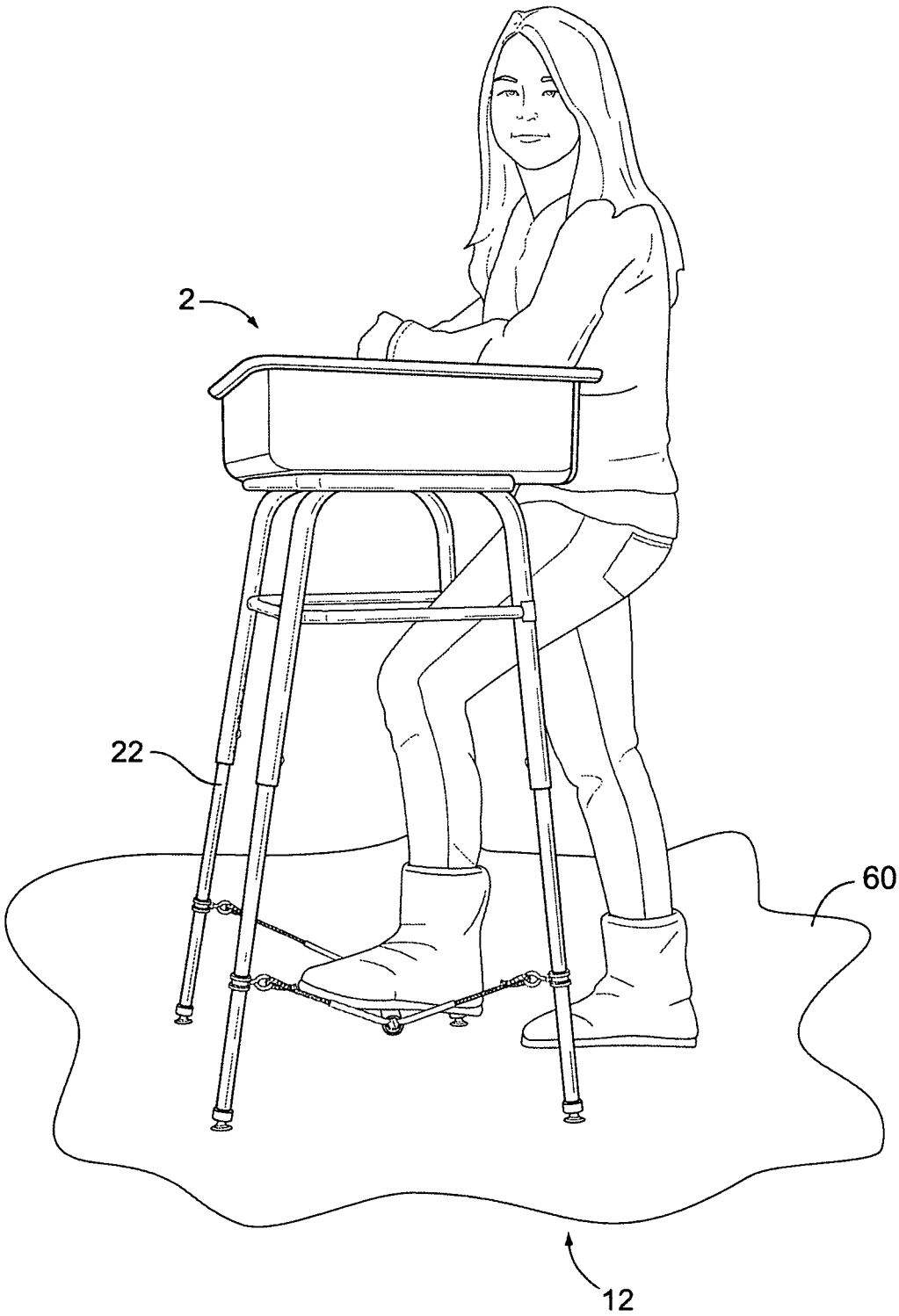
FIG 5. is an isometric view of the physical activity apparatus attached to leg extensions of a standup desk.
Figure 6:
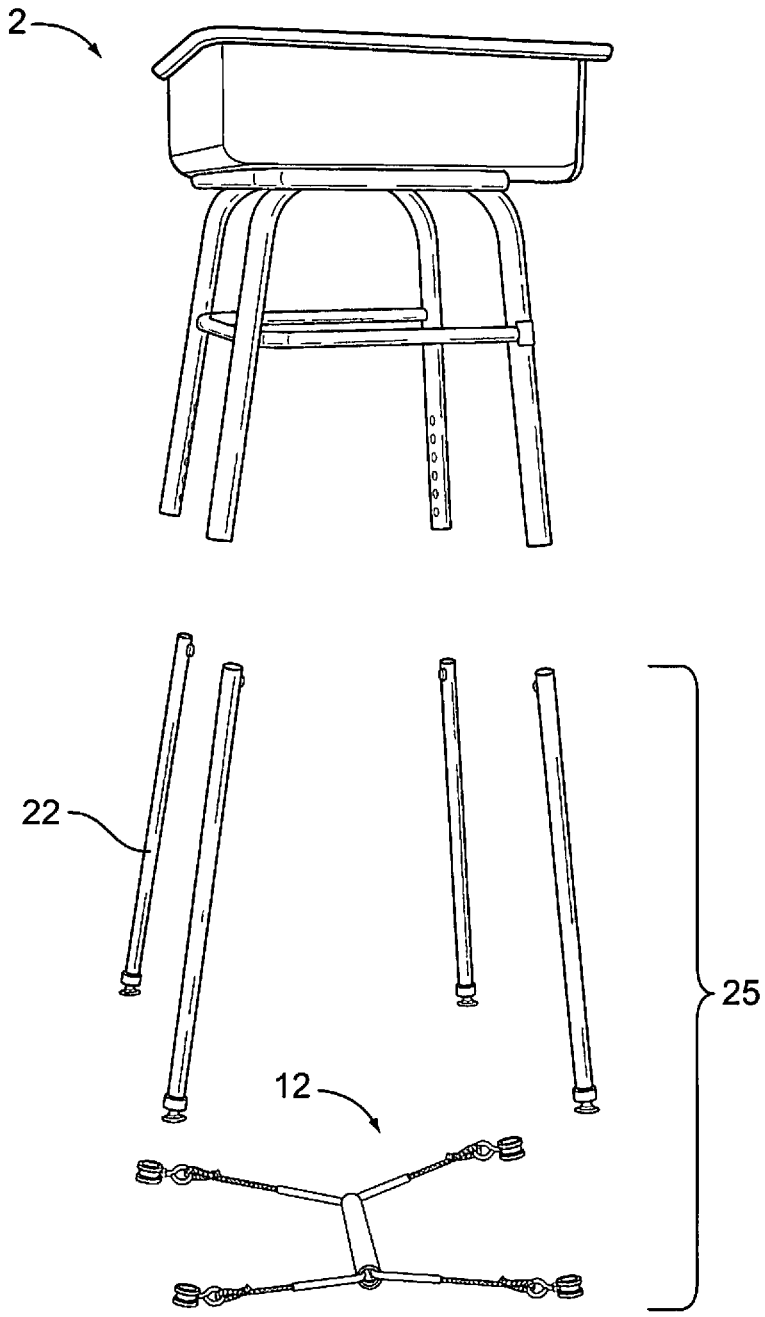
FIG. 6 is an isometric exploded view of the physical activity apparatus and the leg extensions as a kit to be connected to a desk.
Figure 7:
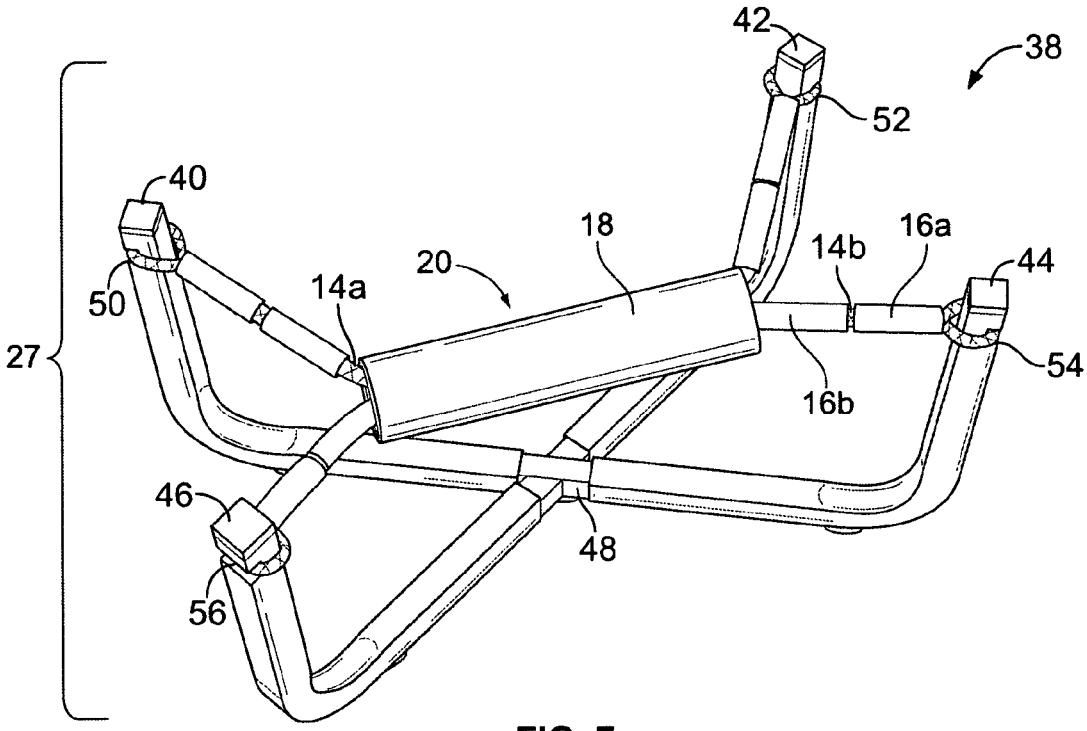
FIG. 7 is an isometric view of the standalone base with the physical activity apparatus attached.
Figure 8:
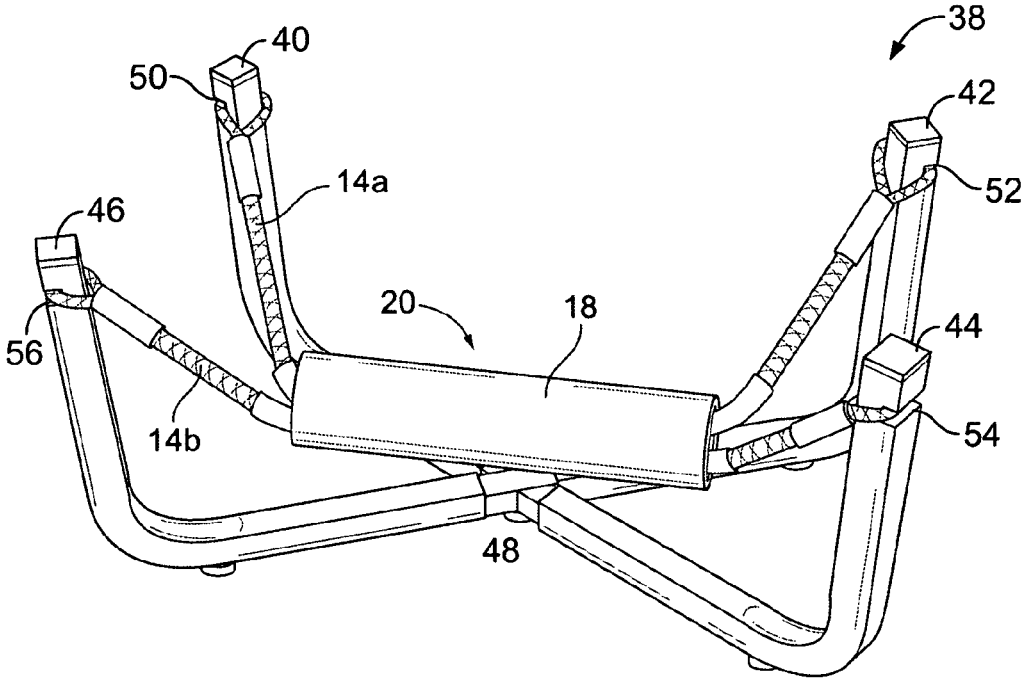
FIG. 8 is another isometric view of the standalone base with the physical activity apparatus attached, illustrating covers around the cords being partially removed.
Figure 9:
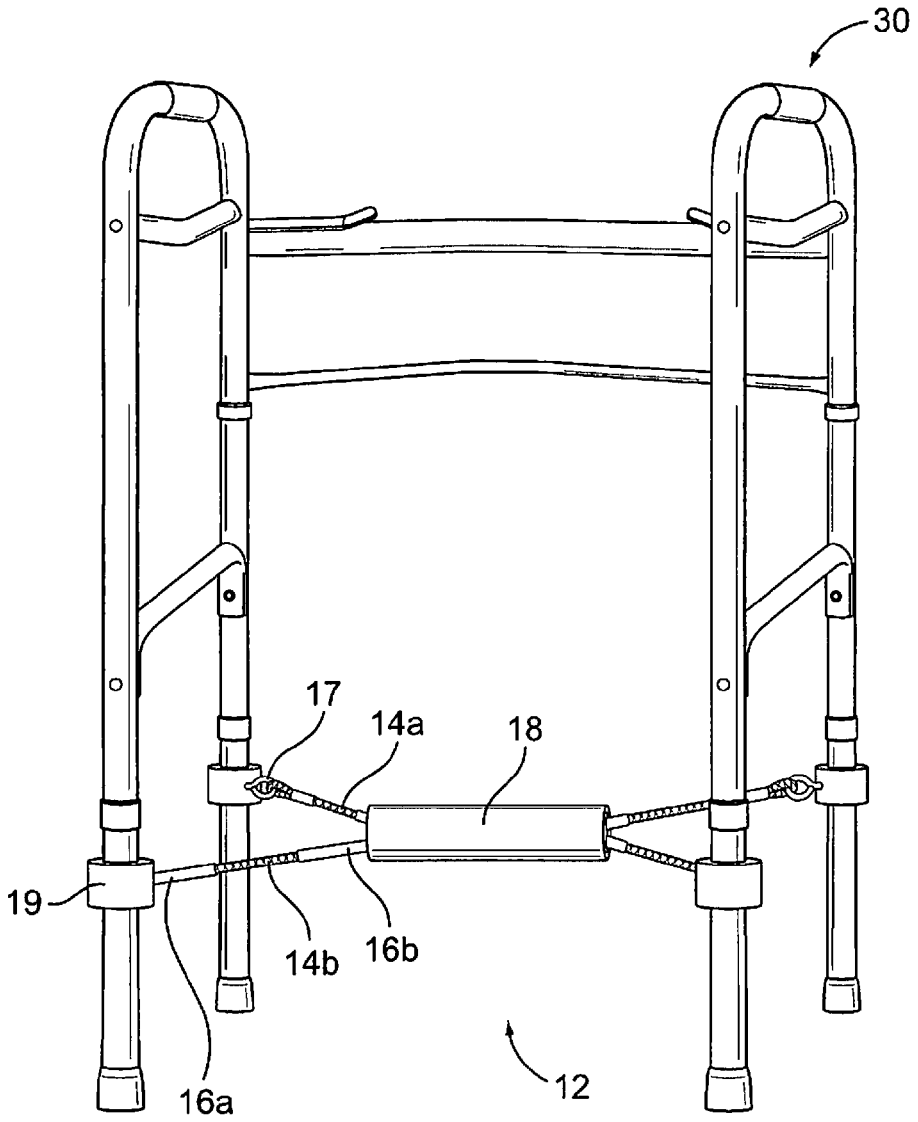
FIG. 9 is an isometric view of a walker with the physical activity apparatus attached.

What is claimed is:

1. A physical activity system for people having a need to expend energy while remaining generally immobile comprising:

a support structure having four spaced apart legs;

a first elastic cord having first and second ends, the first end of the first cord being connected to a first leg of the support structure and the second end of the first elastic cord being connected to a second leg of the support structure;

a first sleeve disposed around and supported by the first elastic cord;

a second elastic cord having first and second ends, the first end of the second elastic cord being connected to a third leg of the support structure and the second end of the second elastic cord being connected to a fourth leg of the support structure;

a second sleeve disposed around and supported by the second elastic cord; and a footpad sleeve disposed around the first and second sleeves and supported by the first and second elastic cords, the first elastic cord, the second elastic cord, the first sleeve, the second sleeve and the footpad sleeve depending from the first, second, third and fourth legs of the support structure, and the footpad sleeve for receiving a user's foot in operation to move the first and second elastic cords in a generally vertical direction between retracted and extended configurations.

2. The physical activity system of claim 1, wherein:
the first end of the first elastic cord forms a loop;
the second end of the first elastic cord forms a loop;
the first end of the second elastic cord forms a loop; and
the second end of the second elastic cord forms a loop.

3. The physical activity system of claim 1, wherein:
each of the first, second, third and fourth legs of the support structure includes a horizontally directed groove.

4. The physical activity system of claim 1, wherein:
the footpad is a right circular cylinder.

5. The physical activity system of claim 1, wherein:
the first end of the first elastic cord forms a loop;
the second end of the first elastic cord forms a loop;
the first end of the second elastic cord forms a loop;
the second end of the second elastic cord forms a loop;
each of the first, second, third and fourth legs of the support structure includes a horizontally directed groove to receive a loop of the elastic cords; and
the footpad is a right circular cylinder for loosely receiving the sleeve covered elastic cords.

6. The physical activity system of claim 5, wherein:
the support structure includes a base with four upstanding legs.

7. The physical activity system of claim 5, wherein:
the support structure includes a desk with four depending legs.

8. The physical activity system of claim 5, wherein:
the grooves of the first, second, third and fourth legs of the support structure define a horizontal plane.

9. The physical activity system of claim 1, wherein:
the footpad sleeve pivots the first and second elastic cords when operated by a user's foot.

10. The physical activity system of claim 9, wherein:
the first end of the first elastic cord forms a loop;
the second end of the first elastic cord forms a loop;
the first end of the second elastic cord forms a loop;
the second end of the second elastic cord forms .a loop; and
each of the first, second, third and fourth legs of the support structure includes a horizontally directed groove to receive a loop of an elastic cord.

11. The physical activity system of claim 10, wherein:
the footpad is a right circular cylinder.

12. The physical activity system of claim 11, wherein:
the support structure includes a base with four upstanding legs.

13. The physical activity system of claim 12, wherein:
the footpad is disposed midway between the legs of the support structure.

14. A physical activity system comprising:
a support structure having first, second, third and fourth spaced apart legs, each leg having a horizontally disposed groove;
a first elastic cord having a first looped end and a second looped end, the first looped end of the first cord being disposed in the groove of the first leg of the support structure and the second looped end of the first elastic cord being disposed in the groove of the second leg of the support structure;
a first sleeve disposed around and supported by the first elastic cord;
a second elastic cord having a first looped end and a second looped end, the first looped end of the second elastic cord being disposed in the groove of the third leg of the support structure and the second looped end of the second elastic cord being disposed in the groove of the fourth leg of the support structure;
a second sleeve disposed around and supported by the second elastic cord; and
a footpad sleeve disposed around the first and second sleeves and supported by the first and second elastic cords midway between the legs of the support structure, wherein the first elastic cord, the second elastic cord, the first sleeve, the second sleeve and the footpad sleeve hang downwardly at rest, the first and second elastic cords are in a retracted configuration when at rest, and the first and second elastic cords are movable between retracted and extended configurations in operation when the footpad sleeve is operated by a user's foot.

15. The physical activity system of claim 14, wherein:
the footpad is a right circular cylinder.

16. The physical activity system of claim 15, wherein:
the grooves of the first, second, third and fourth legs of the support structure define a horizontal plane.

17. The physical activity system of claim 16, wherein:
the support structure includes a base and four upstanding legs.

18. The physical activity system of claim 16, wherein:
the support structure includes a desk and four leg extensions.

* * * * *